US005224458A

United States Patent [19]

Okada et al.

[11] Patent Number: 5,224,458

[45] Date of Patent: Jul. 6, 1993

[54] MULTI-HOLE INJECTOR WITH IMPROVED ATOMIZATION AND DISTRIBUTION

[75] Inventors: Takashi Okada; Toshiro Makimura; Kaneo Imamura, all of Obu, Japan

[73] Assignee: Aisan Kogyo Kabushiki Kaisha, Aichi, Japan

[21] Appl. No.: 953,936

[22] Filed: Sep. 30, 1992

[30] Foreign Application Priority Data

Oct. 31, 1991 [JP] Japan ..... 3-313238

[51] Int. Cl.[5] ..... F02M 23/00

[52] U.S. Cl. ..... 123/531; 123/432; 239/533.12

[58] Field of Search ..... 123/531, 533, 432; 239/533.12

[56] References Cited

U.S. PATENT DOCUMENTS 4,519,370 5/1985 Iwata ..... 239/533.12
4,657,189 4/1987 Iwata et al. ..... 239/533.12
4,771,948 9/1988 Furukawa et al. ..... 239/533.12
4,890,594 1/1990 Duret ..... 123/531
4,945,877 8/1990 Ziegler et al. ..... 123/531
4,971,254 11/1990 Daly et al. ..... 239/533.12
4,982,716 1/1991 Takeda et al. ..... 123/531
5,062,573 11/1991 Makimura ..... 239/533.12

*Primary Examiner*—E. Rollins Cross
*Assistant Examiner*—Erick Solis
*Attorney, Agent, or Firm*—Dennison, Meserole, Pollack & Scheiner

[57] ABSTRACT

A fuel injector of the type in which a valve hole is opened and closed by a valve so as to intermittently inject pressurized fuel from the valve hole includes a distributing adapter fixedly attached to a front end of the valve hole, and an air adapter fixedly attached to a front end of the distributing adapter. The air adapter is formed with a plurality of guide holes directed to a plurality of intake ports of the engine, respectively, and assist air passages each communicating laterally with a corresponding one of the guide holes. The distributing adapter is formed with distributing holes of the same number as the guide holes, each of the distributing holes extending between the valve hole and a corresponding one of the guide holes.

11 Claims, 5 Drawing Sheets

MULTI-HOLE INJECTOR WITH IMPROVED ATOMIZATION AND DISTRIBUTION

BACKGROUND OF THE INVENTION

1. Field of the Invention

Recently, in order to obtain higher output of an engine, a plurality of intake ports are provided for each of the cylinders in the engine. For use in such an engine, an injector has been proposed having a plurality of guide holes through which fuel is guided into the respective intake ports.

The present invention relates to a multi-hole injector having a plurality of guide holes, and more specifically to a multi-hole injector with improved atomization and distribution.

2. Description of the Prior Art

An example of an injector having a plurality of guide holes is disclosed in U.S. Pat. No. 4,982,716. FIG. 5 shows the construction of the prior art injector. In FIG. 5, the injector includes a valve 126 for opening and closing a valve hole 118, and when the valve 126 is pulled upwardly, the valve hole 118 is opened and fuel Fp is injected from the valve hole 118. An adapter 145 is attached to a front end of the valve hole 118, and has a receiving hole 124 for receiving the injected fuel, the receiving hole 124 being divided downstream in a plurality of guide holes 137 through which the fuel is guided. The guide holes 137 are formed so as to be directed to corresponding intake ports (not shown). Assist air passages 138 are provided through side walls of the guide holes 137 so as to blow assist air into the guide holes 137.

In the injector thus constructed, fuel Fp injected from the valve hole 118 is introduced into the receiving hole 124 and then divided to be fed into the guide holes 137, where the fuel is atomized by assist air blown therein through the assist air passages 138 and is blown out toward the respective intake ports (not shown).

Another example of such a multi-hole injector is disclosed in U.S. Pat. No. 5,062,573. The construction of the injector is shown in FIGS. 6 and 7. The injector includes an adapter 145 formed with a receiving hole 124 which is divided downstream in three guide holes 137. The adapter 145 includes an atomization plate 130 disposed between the receiving hole 124 and the guide holes 137. As shown in FIG. 7, the atomization plate 130 includes an impactor 132 against which fuel injected from the valve hole 118 impacts to be atomized and three openings 136 through which the atomized fuel is introduced into the guide holes 137.

In the injector as disclosed in either of the above mentioned U.S. Pat. Nos. 4,982,716 and 5,062,573, the fuel injected from the valve hole 118 is received in the receiving hole 124 and then divided to be introduced into the guide holes 137. If there is any deviation in the positional relationship between the valve hole 118 and the guide holes 137, a larger amount of fuel will flow into one of the guide holes 137, while a smaller amount of fuel will flow into another one. This causes difficulty in achieving good distribution of fuel.

SUMMARY OF THE INVENTION

An object of the present invention is to provide a multi hole injector which can provide good distribution and atomization.

Another object of the present invention is to provide a multi-hole injector which can provide good distribution and atomization characteristics without very severe dimensional control and which can be manufactured at a low cost.

To achieve the above objects, in accordance with the present invention, a distributing adapter is provided between a valve hole and guide holes, the adapter being formed with distributing holes which are the same in number as the guide holes and which extend between the valve hole and the corresponding guide holes. Thus, the amounts of fuel divided to be fed in the respective guide holes depend on the areas of the respective distributing holes, and control of the areas of the distributing holes with required degree of accuracy assures good distribution.

The invention will be more fully understood from the following detailed description and appended claims when taken with the drawings.

DETAILED DESCRIPTION OF THE PREFERRED EMBODIMENT

Now, a preferred embodiment of the present invention will be described with reference to the drawings. In the following embodiment, the present invention is adapted to a double-hole injector for use in a vehicular engine.

Figure 3:
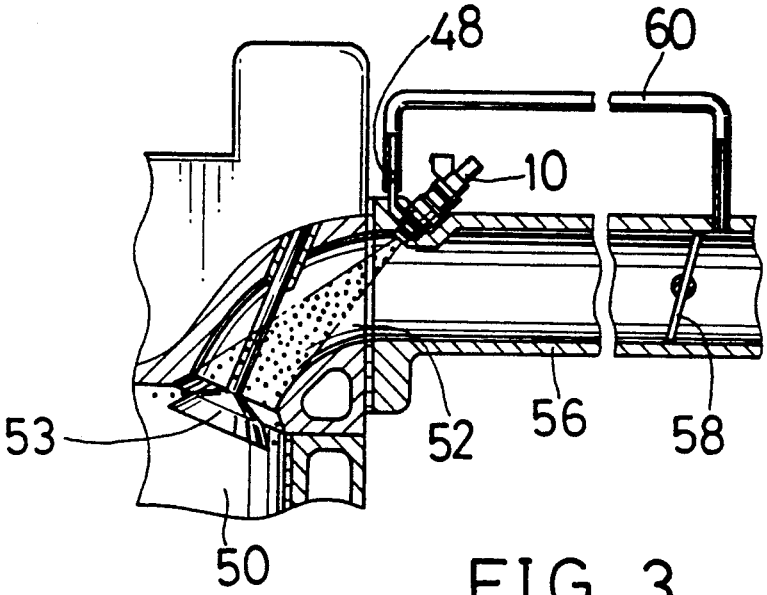
FIG. 3 is a view illustrating the injector mounted in an intake manifold as seen laterally.
Figure 4:
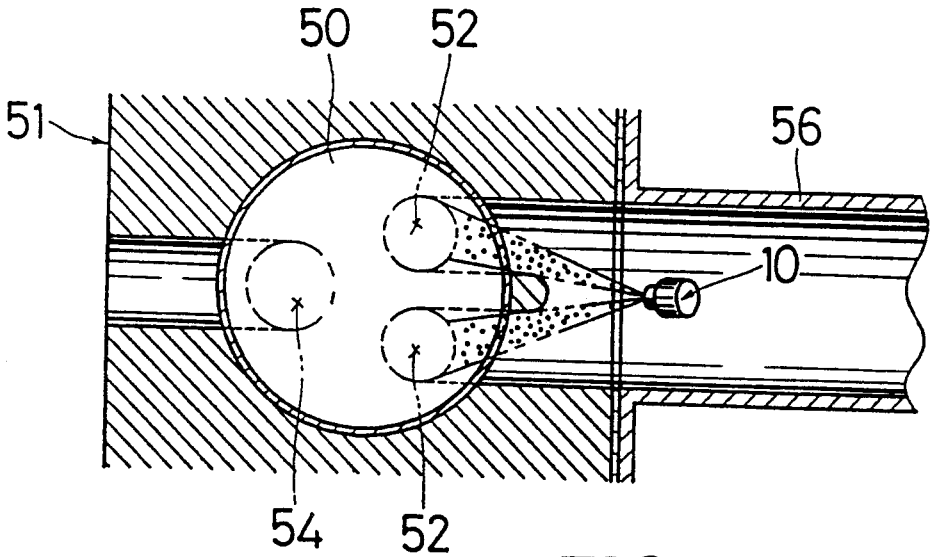
FIG. 4 is a view illustrating injector mounted in the intake manifold as seen from above.
Figure 5:
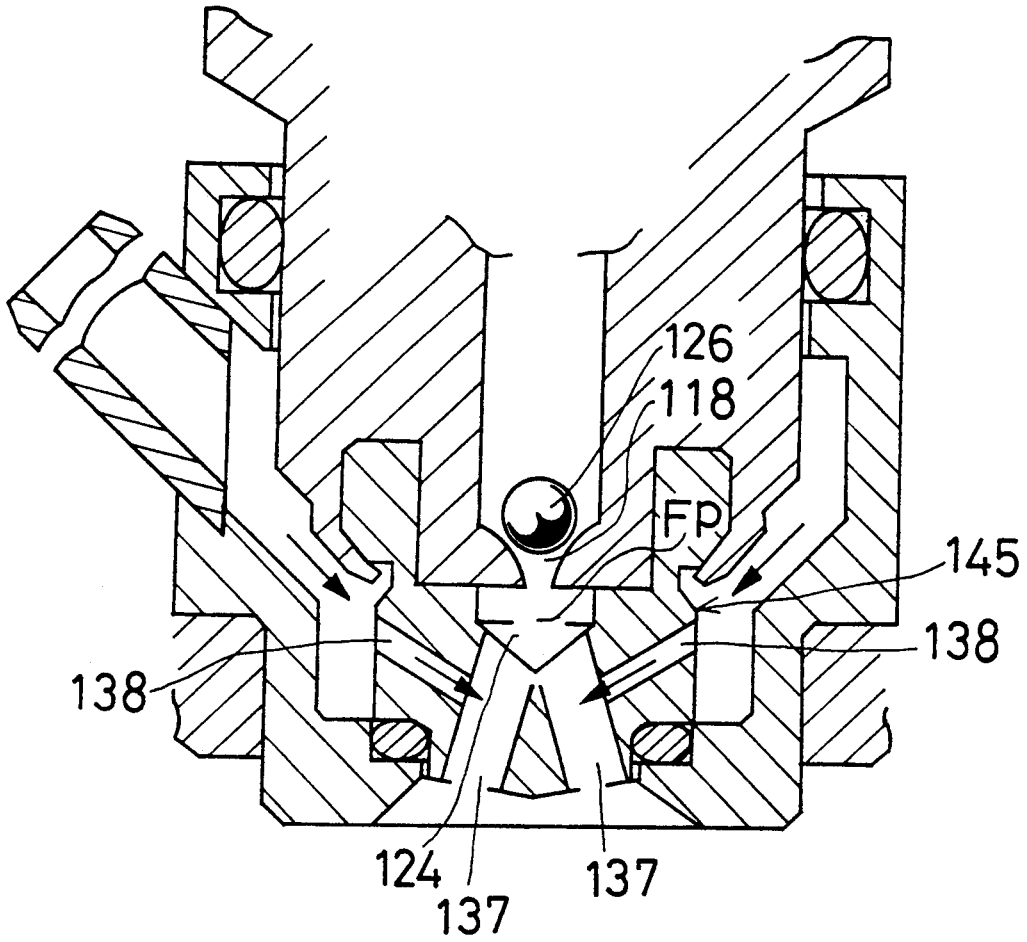
FIG. 5 PRIOR ART
FIG. 5 is a view of a prior art injector construction.
Figure 6:
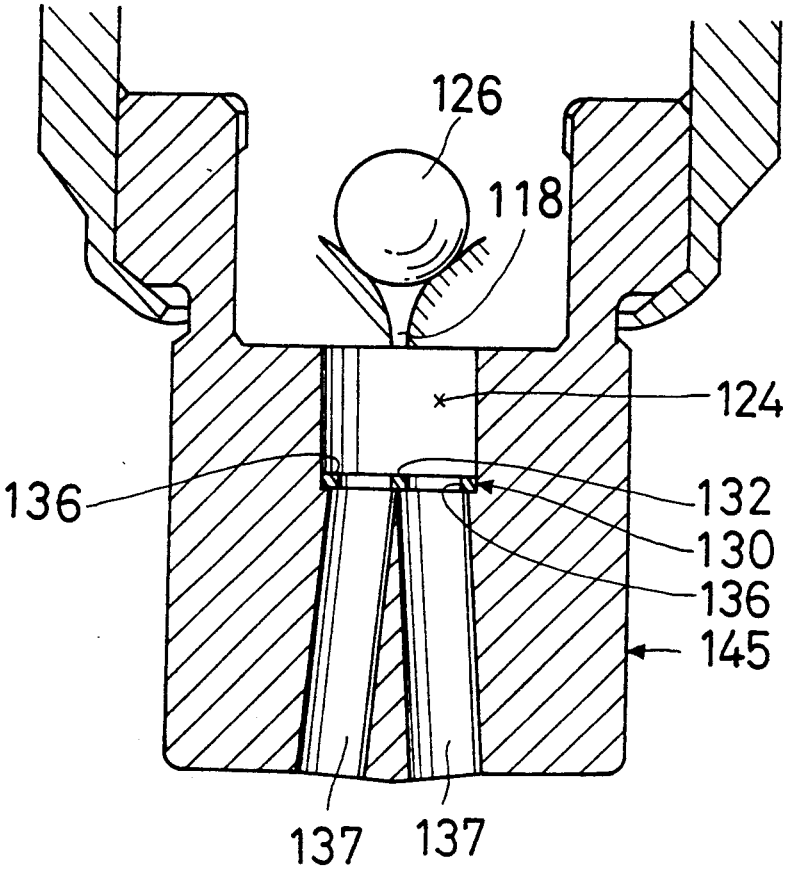
FIG. 6 PRIOR ART
FIG. 6 is a view of another prior art injector construction.
Figure 7:
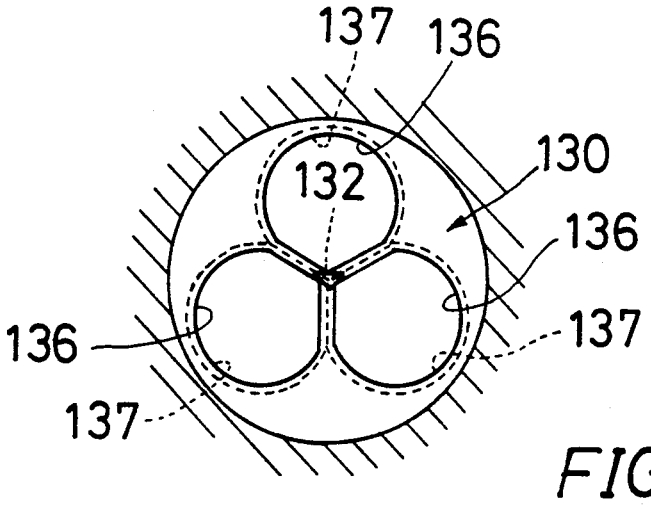
FIG. 7 PRIOR ART
FIG. 7 is a plan view of the plate shown in FIG. 6.

FIG. 3 is a vertical sectional view showing associated portions of a cylinder 50 of the engine and an intake manifold 56, and FIG. 4 is a cross sectional view thereof. As shown in FIGS. 3 and 4, the cylinder 50 has two intake ports 52 and an exhaust port 54. Both of the intake ports 52 communicate with an intake air passage of the intake manifold 56, and a throttle valve 58 well known in the art is disposed in the passage so as to control opening and closing thereof. A double-hole injector 10 for injecting fuel separately toward the intake ports 52 of the cylinder 50 is mounted in a wall of the intake manifold 56. In FIG. 3, each of the intake ports 52 is provided with an intake valve 53.

Figure 1:
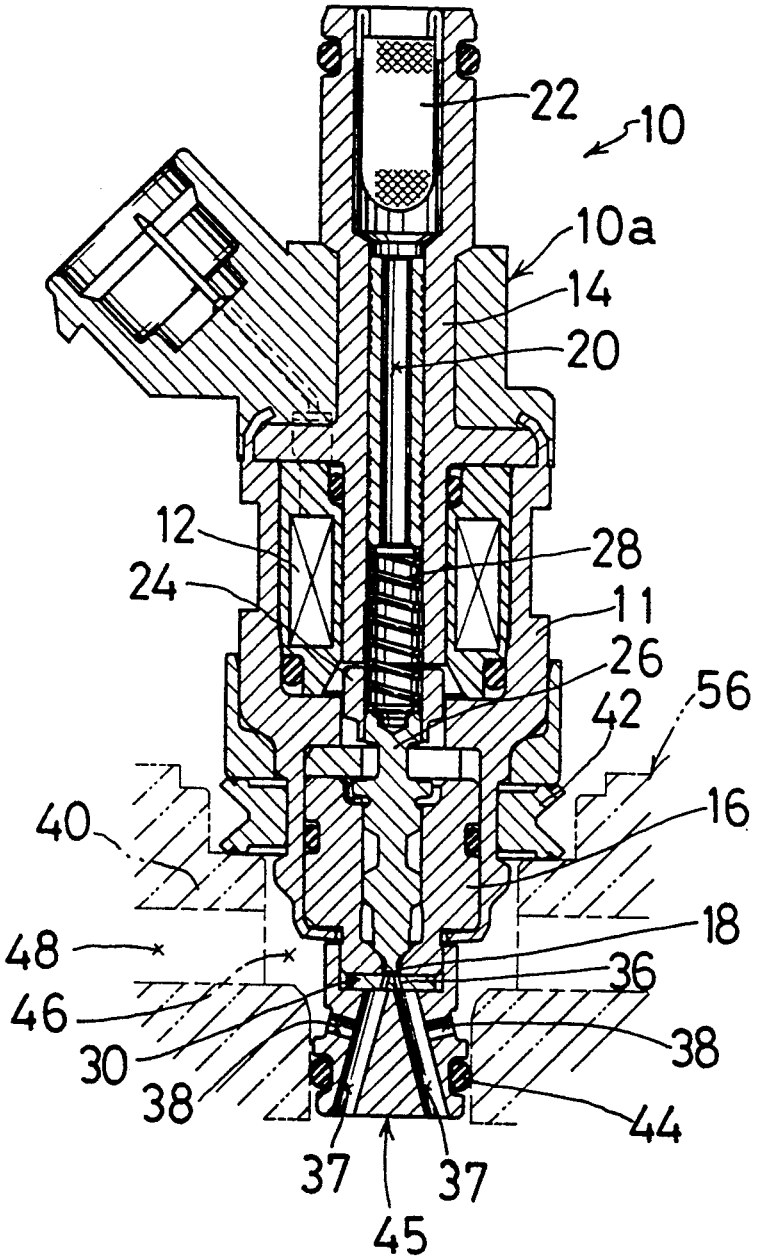
FIG. 1 is a longitudinal sectional view of an embodiment of the multi-hole injector according to the present invention.
Figure 2:
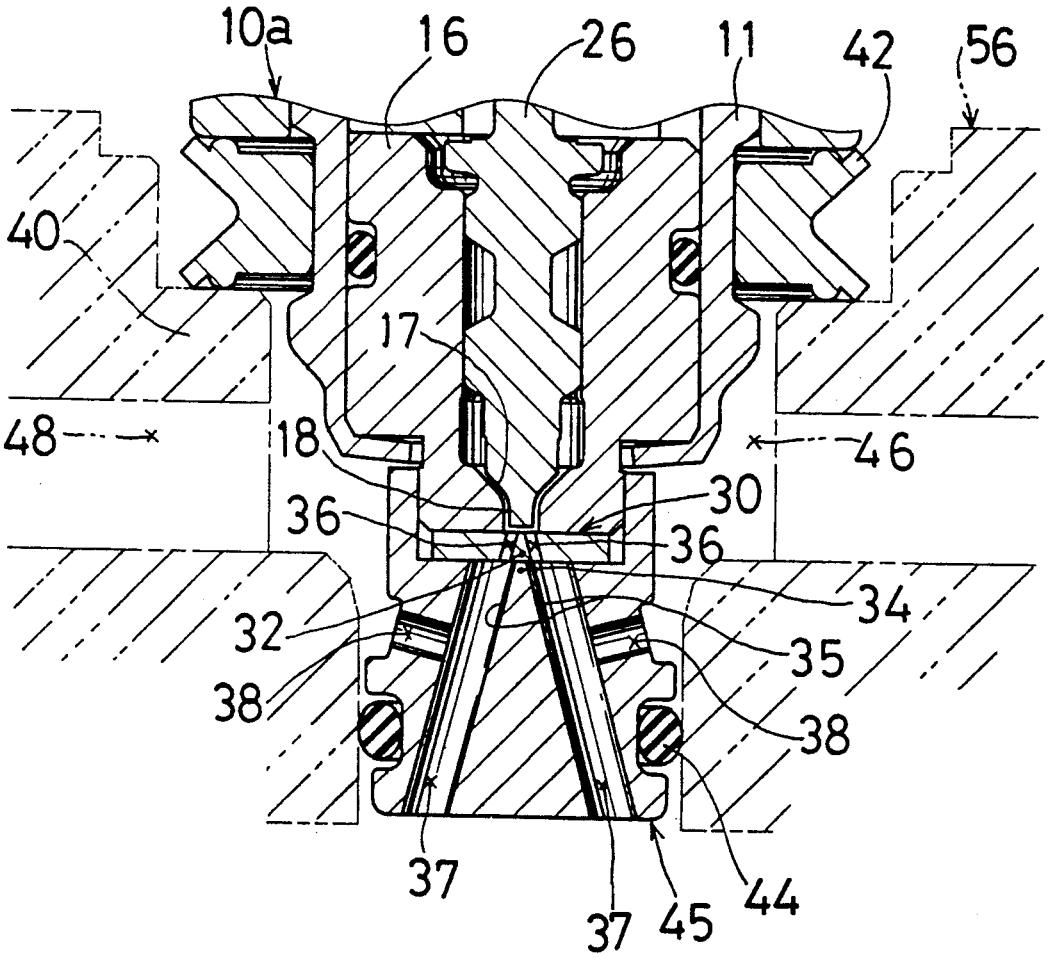
FIG. 2 is an enlarged view of the essential part of FIG. 1.

FIG. 1 is a sectional view of the injector 10, and FIG. 2 is an enlarged view of a part of the injector 10 shown in FIG. 1. The description will be first related to an injector body **10*a* which is a main component of the injector 10. As seen in FIG. 1, the injector 10 includes a casing 11 in which a solenoid coil 12, a hollow core 14 and an armature 24 are housed. When the solenoid coil 12 is energized, the core 14, the armature 24 and a part of the casing 11 establish a magnetic circuit, which generates magnetic force effective to cause the armature 24 to slide upwardly from the position in FIG. 1 against the urging force of a valve spring 28 along with a valve 26** which will be mentioned later.

A valve housing 16 is provided in the casing 11 downwardly of the armature 24 as seen in FIG. 1. The valve housing 16 has inside thereof a hollow space in coaxial alignment with the hollow portions of the core 14 and the armature 24. As seen in FIG. 2, the valve housing 16 includes a valve hole 18 opening at the lower end thereof and communicating with the hollow interior, and a valve seat 17 is formed inside of the valve hole 18.

A solid valve 26 is provided within the valve housing 16. The valve 26 is fixed to the armature 24 so as to be slidingly movable with the armature 24, as described above. The valve 26 is normally pressed at the front end (lower end in FIGS. 1 and 2) thereof against the valve seat 17 of the valve housing 16 under the urging force of the valve spring 28 to close the valve hole 18.

In FIG. 1, a strainer 22 is fitted in the upper end hollow portion of the core 14, and the hollow portions arranged in series from the upper end portion of the core 14 to the valve hole 18 form a fuel passage 20 in the injector 10.

In FIGS. 1 and 2, an air adapter 45 is fitted on the front end of the injector body 10*a* or the front end (lower end in FIG. 1) of the valve housing 16, with a disc-like distributing adapter 30 interposed therebetween. The distributing adapter 30 may be mounted otherwise by welding or press-fitting.

The distributing adapter 30 is formed with two distributing holes 36 communicating with the valve hole 18 in the valve housing 16 and separated by a splitter 32. The distributing holes 36 extend through the distributing adapter 30 to the lower end surface thereof. Each of the distributing holes 36 is drilled so as to have an opening area equal to each other. Alternative machining means including punching, electric discharge machining or laser beam machining may be employed in place of drilling. The distributing holes 36 have lower openings directed to the corresponding intake ports 52 of the cylinder 50 as shown in FIGS. 3 and 4.

The air adapter 45 is formed with two guide holes 37 communicating with the lower openings of the distributing holes 36 in the distributing adapter 30 and separated by a splitter 34. Each of the guide holes 37 has a diameter substantially equal to or larger than that of each of the distributing holes 36 in the distributing adapter 30 and is disposed in a direction parallel to the corresponding distributing hole 36. The guide holes 37 are opened at the lower end surface of the air adapter 45. The lower openings of the guide holes 37 are directed to the corresponding intake ports 52 of the cylinder 50 as shown in FIGS. 3 and 4.

As shown in FIGS. 1 and 2, the air adapter 45 is also formed with air feed passages 38 extending through the air adapter 45 from the outer periphery thereof to the corresponding guide holes 37 so as to feed assist air. The air feed passages 38 communicate with the corresponding guide holes 37 at positions downstream of separation thereof by the splitter 34.

The front end portion (lower end portion in the drawing) of the injector 10 including the distributing adapter 30, the air adapter 45 and a portion of the casing 11 is fitted in an injector mounting member 40 of the intake manifold 56 as shown in two dot chain lines in FIGS. 1 and 2. Air seals 42, 44 are disposed so as to assure airtight mounting of the injector mounting member 40 relative to the casing 11 and the air adapter 45, respectively. Thus, an airtight air gallery 46 is defined within the injector mounting member 40 and communicates with the air feed passages 38.

The intake manifold 56 is provided with an air passage 48 communicating with the air gallery 46 and extending outside. As shown in FIG. 3, the air passage 48 communicates through an air pipe 60 with a portion of the intake manifold 56 upstream of the throttle valve 58.

In the injector thus constructed, when the solenoid coil 12 is energized to generate magnetic force, the valve 26 is actuated upwardly (as seen in FIG. 2) to open the valve hole 18, as described above. Therefore, the fuel supplied to the fuel passage 20 is injected from the valve hole 18 and separated in two streams flowing through the two distributing holes 36 in the distributing adapter 30 and then through the corresponding guide holes 37 in the air adapter 45.

The distributing holes 36 are equal in opening area, so that fuel is equally divided. With this construction, the positional relationship between the distributing holes 36 and the valve hole 18 is not so critical, and dislocation of the distributing holes 36 in relation to the center of the valve hole 18 will not interfere with equally divided fuel flow into the distributing holes 36.

In operation the pressure difference between the guide holes 37 and the intake manifold 56 causes the atmospheric air to flow through the air passage 48 into the guide holes 37. Specifically, the fuel introduced into the distributing holes 36 in the distributing adapter 30 is divided into two or more fuel streams. These fuel streams then flow through the guide holes 37 of the air adapter 45, where assist air is fed into the fuel streams. This permits effective atomization of the fuel to be injected toward the intake ports 52 of the cylinder 50, as shown in FIGS. 3 and 4.

Thus, in the double-hole injector, fuel is uniformly divided by the distributing adapter 30 and atomized by assist air, allowing the fuel to be uniformly distributed and injected in each of the intake ports of the cylinder. This assures improved combustibility of the engine as well as increased output and better fuel consumption performance.

A preferred embodiment of the present invention has been described with reference to the drawing, but the present invention is not limited by this embodiment and may be exemplified in various other embodiments.

For example, the inclination of the distributing holes 36 of the distributing adapter 30 can be different from that of the guide holes 37 of the air adapter 45, so that fuel fed through the distributing holes 36 of the distributing adapter 30 may impact against inclined surfaces of the splitter 34 of the air adapter 45 to be atomized, and when assist air is fed into the guide holes 37, the fuel thus atomized will be more finely atomized.

The assist air introduced from the intake manifold into the air passage 38 may be replaced by compressed air given by a compressor or the like.

Furthermore, the intake ports 52 of each cylinder 50, the distributing holes 36 in the distributing adapter 30 and the guide holes 37 in the air adapter 45 may be three or more in number, respectively.

The distributing holes 36 of the distributing adapter 30 may have different opening areas. In some types of engines, it is desirable to inhale different amounts of fuel through the ports. According to the present invention, such a requirement can be readily satisfied by providing the opening areas of the distributing holes in a ratio as desired. The opening areas of the distributing holes can be adjusted only by changing the contour of the holes, assuring ready achievement of required degree of accuracy.

Thus, according to the present invention, fuel is uniformly divided by the adapter and then atomized by assist air, assuring uniform distribution and injection of the fuel in the intake ports of each cylinder.

What is claimed is:

1. A fuel injector of the type in which a valve hole is opened and closed by a valve so as to intermittently inject pressurized fuel from the valve hole, comprising:

a distributing adapter fixedly attached to a front end of the valve hole; and an air adapter fixedly attached to a front end of said distributing adapter;

said air adapter being formed with a plurality of guide holes extending linearly toward a corresponding plurality of intake ports of an engine, and said air adapter having assist air passages communicating laterally with a corresponding one of said guide holes;

said distributing adapter being formed with distributing holes of the same number as the number of said guide holes, each of said distributing holes extending between the valve hole and a corresponding one of said guide holes;

each one of said guide holes being disposed in a parallel direction to a corresponding one of said distributing holes.

2. The fuel injector as defined in claim 1, wherein said distributing adapter is a plate-like member, and said distributing holes are drilled.

3. The fuel injector as defined in claim 1, wherein said distributing adapter is a plate-like member, and said distributing holes are punched.

4. The fuel injector as defined in claim 1, wherein said distributing adapter is a plate-like member, and said distributing holes are formed by electric discharge machining.

5. The fuel injector as defined in claim 1, wherein said distributing adapter is a plate-like member, and said distributing holes are formed by laser beam machining.

6. The fuel injector as defined in claim 1, wherein said distributing holes are smaller in cross-sectional area than said guide holes.

7. The fuel injector as defined in claim 1, wherein said distributing adapter and said air adapter are separate members.

8. A fuel injector of the type in which a valve hole is opened and closed by a valve so as to intermittently inject pressurized fuel from the valve hole, comprising:

a distributing adapter fixedly attached to a front end of the valve hole; and an air adapter fixedly attached to a front end of said distributing adapter;

said air adapter being formed with a plurality of guide holes extending linearly toward a corresponding plurality of intake ports of an engine, and said air adapter having assist air passages communicating laterally with a corresponding one of said guide holes, and with a splitter formed between said guide holes, said splitter having inclined surfaces;

said distributing adapter being formed with distributing holes of the same number as the number of said guide holes, each of said distributing holes extending between the valve hole and a corresponding one of said guide holes; and said distributing holes being directed to said inclined surfaces of said splitter in the air adapter.

9. In a fuel injector of the type in which a housing includes a valve seat formed with a valve hole in its front end, said valve hole is opened and closed by a valve so as to intermittently inject pressurized fuel through the valve hole, comprising:

a disc shaped adapter having an upper surface fixedly attached to the front end of the valve hole;

an air adapter fixedly attached to a lower surface of said disc shaped adapter;

said air adapter being formed with a plurality of guide holes extending linearly toward a plurality of intake ports of an engine, and including assist air passages, each of said passages communicating laterally with a corresponding one of said guide holes;

said disc shaped adapter being formed with a plurality of distributing holes corresponding to the plurality of said guide holes, each of said distributing holes extending between the valve hole and a corresponding one of said guide holes;

each of said distributing holes being directed towards a corresponding intake port of an engine.

10. In the fuel injector of claim 9, wherein each one of said guide holes is disposed in a direction which is parallel to a corresponding one of said distributing holes.

11. In the fuel injector of claim 9, wherein said air adapter includes a splitter formed between said guide holes, said splitter having inclined surfaces and said distribution holes are directed towards the inclined surfaces.

* * * * *